US005279140A

United States Patent [19]

Blake et al.

[11] Patent Number: 5,279,140

[45] Date of Patent: Jan. 18, 1994

[54] TOOL HANDLES HAVING WEAR INDICATION

[75] Inventors: Mark W. Blake, Milford; Christopher G. Chadbourne, Nashua; Gennaro L. Pecora, Manchester, all of N.H.

[73] Assignee: Burndy Corporation, Norwalk, Conn.

[21] Appl. No.: 884,674

[22] Filed: May 18, 1992

[51] Int. Cl.[5] ..... H01R 43/042

[52] U.S. Cl. ..... 72/31; 72/410; 81/427.5; 29/751; 403/27; 76/119

[58] Field of Search ..... 72/410, 409, 31, 35; 81/DIG. 5, 427.5; 403/27; 29/751; 76/119

[56] References Cited

U.S. PATENT DOCUMENTS

| | | | |
|---|---|---|---|
| Re. 24,604 | 2/1959 | Reider, Jr. . | |
| 2,244,482 | 6/1941 | Baxter et al. . | |
| 2,254,416 | 9/1941 | Burns . | |
| 2,972,270 | 2/1961 | Krolic | 72/409 |
| 2,994,238 | 8/1961 | Matthysse . | |
| 3,084,575 | 4/1963 | Klein . | |
| 3,181,341 | 5/1965 | Thornton et al. . | |
| 3,182,485 | 5/1965 | Sund . | |
| 3,330,148 | 7/1967 | Hornung . | |
| 3,345,856 | 10/1967 | Werner et al. . | |
| 3,396,571 | 8/1968 | Porter . | |
| 3,872,528 | 3/1975 | Porter | 7/5.3 |
| 4,433,569 | 2/1984 | Santinelli | 72/410 |
| 4,713,874 | 12/1987 | Schwartz | 29/751 |
| 4,824,275 | 4/1989 | Schlonski | 403/27 |
| 4,926,685 | 5/1990 | Shannon, Sr. | 72/410 |
| 5,069,058 | 12/1991 | Hyatt | 72/402 |

FOREIGN PATENT DOCUMENTS

| | | | |
|---|---|---|---|
| 549356 | 11/1942 | United Kingdom | 72/409 |

OTHER PUBLICATIONS

Advertisement "New Burndy Hytool MD6-8" (2 pages).

*Primary Examiner*—Daniel C. Crane
*Attorney, Agent, or Firm*—Perman & Green

[57] ABSTRACT

A hand operated tool is provided having a working head and a pair of handles. The handles are operably connected to each other and to the working head. The handles are each made of a one-piece polymer member which can indicate wear of the handles at their connection to each other.

9 Claims, 2 Drawing Sheets

TOOL HANDLES HAVING WEAR INDICATION

BACKGROUND OF THE INVENTION

1. Field of the Invention

The present invention relates to hand operated tools and, more particularly, to handles for such tools.

2. Prior Art

Various different handles are known in the prior art relating to hand operated tools. U.S. Pat. No. 3,182,485 discloses handles as fiberglass rods. U.S. Pat. No. 3,872,528 discloses handles of cast or forged metal. U.S. Pat. No. 3,330,148 discloses a gaging mechanism for a compression tool. As can be seen from U.S. Pat. No. 3,330,148, a problem exists with certain types of hand operated tools in that the tools have to be adjusted in order to maintain the tool in precise alignment.

It is an object of the present invention to provide a new and improved handle for a hand operated tool.

SUMMARY OF THE INVENTION

In accordance with one embodiment of the present invention, a hand operated compression tool is provided comprising a working head, and a pair of handles. The pair of handles are operably connected to each other and to the working head. The handles comprise means for indicating wear of the handles at their connection to each other, and with their working head.

In accordance with another embodiment of the present invention, a compression tool handle for use with a second handle and a working head of a compression tool is provided. The handle comprises a hand-grip section, a shaft section, and a connection section. The hand-grip section is located at a first end of the handle. The shaft section extends from the hand-grip section. The connection section is located at a second end of the shaft section. The connection section has a wear indicator adapted to show wear of the connection section during use of the handle.

In accordance with one method of the present invention, a method of manufacturing a hand operated tool is provided. The method comprises steps of providing two handles, each handle having means for connecting a portion of a working head thereto, each handle being comprised of a one-piece polymer member; and connecting the two handles to each other to provide for pivotal motion therebetween, the connection comprising a member being positioned in a hole of each handle and through strengthening links, the members being adapted to wear away at the surface of the holes at both the handles' connection to each other and the working head; the surface of the connection section of one side of each handle having a tab that is employed in conjunction with a groove provided on the links, the position of the groove changing with respect to that of the tab as excessive hole wear occurs.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
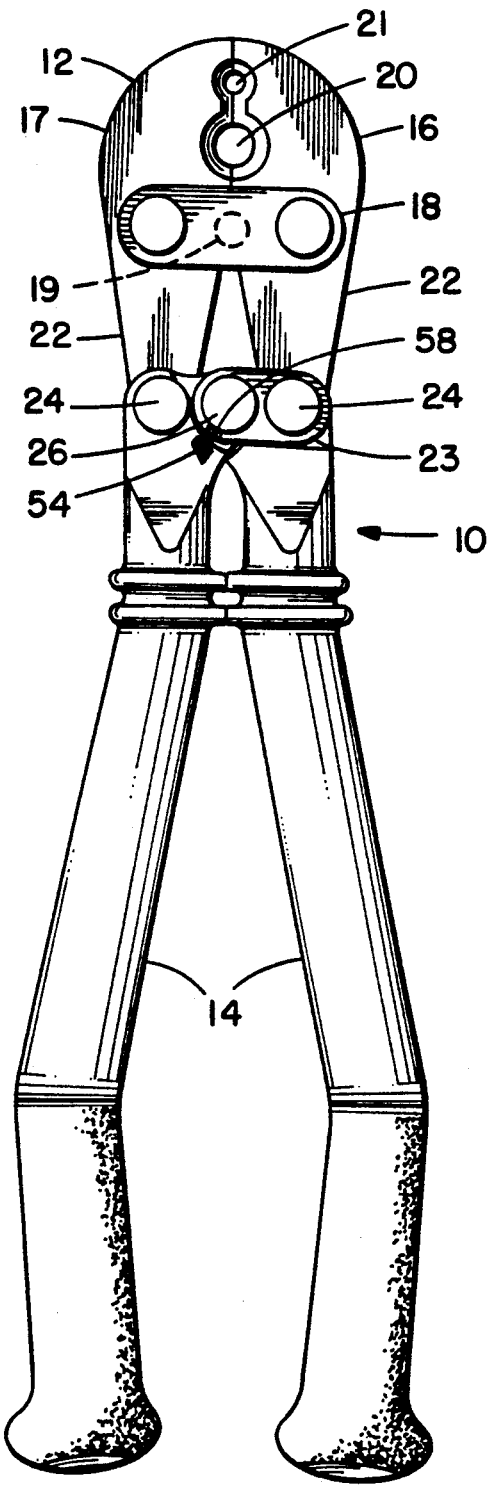
FIG. 1 is a plan front view of a hand operated compression tool incorporating features of the present invention.

Referring to FIG. 1, there is shown a plan front view of a compression tool or crimping tool lo, the rear view being a mirror image thereof. Although the present invention will be described with reference to the single embodiment shown in the drawings, it should be understood that the present invention may be embodied in many alternate forms of embodiment. In addition, any suitable size, shape, or type of elements or materials may be used as further understood below.

The tool 10 generally comprises a working head 12 and two handles 14. The working head 12 is preferably made of metal with two pivotally connected jaws 16, 17, pivoted at pivot location 19 and connected by two plates 18 (only one of which is shown) on opposite sides of the jaws. The jaws 16, 17 each have two compression areas 20 and 21, for crimping a connector to an electrical wire, and a connection end 22 for connecting each of the jaws to one of the handles 14. The connection end 22 of each jaw has a hole for receiving a bolt 24 that operably connects the jaws to a handles 14. The working head 12 is substantially the same as the working head used in the HYTOOL MD6-8 manufactured by Burndy corporation, Norwalk, Conn. However, any suitable type of working head could be used.

Figure 2:
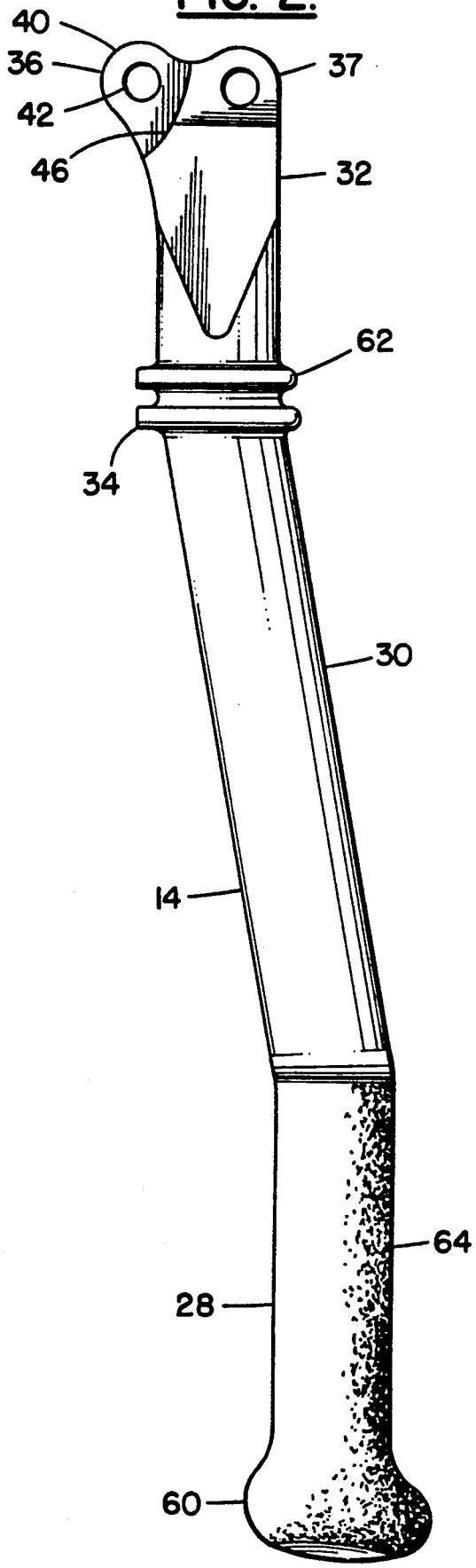
FIG. 2 is a plan front view of one of the handles used in the tool shown in FIG. 1.
Figure 3:
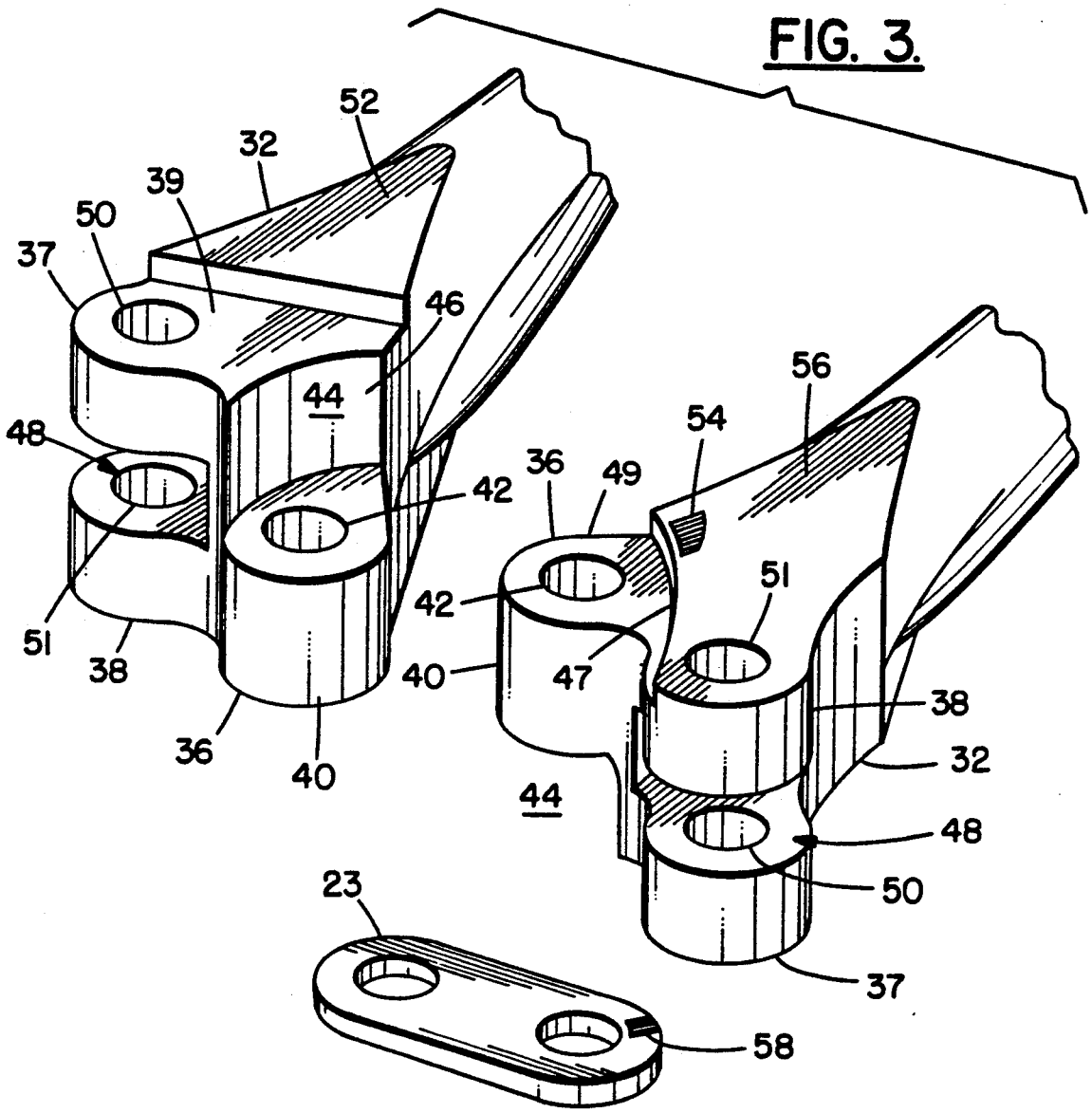
FIG. 3 is a partial exploded perspective view of a connection end of the handles shown in FIG. 1.

In the embodiment shown, the pair of handles 14 are hamaphrodidic; i.e: identical to each other, but orientated reverse to each other. The handles 14 are pivotally connected to each other by a bolt 26 and two strengthening links 23 (only one of which is shown). The links 23 are preferrably made of metal. However, any suitable material could be used. As can be seen in FIG. 3, each link 23 has a plate-like shape with two holes. However, any suitable type of connection could be provided. Referring also to FIGS. 2 and 3, each handle 14 generally comprises a hand grip section 28 at a first end, a shaft section 30, and a connection section 32 at a second end. The handle 14 is preferably made of a dielectric polymer material and provided as a single one-piece member. The hand grip section 28 has a bobbed grip end 60, and knurled finish 64. The shaft section 30 has a stop 34 adapted to contact the stop on the other handle to limit a range of notion of the handles, and dielectric lengthening ribs 62. However, any suitable type of hand grip section or shaft section could be provided. The connection section 32 of each handle 14 generally comprises three projecting portions 36, 37, 38. The first projecting portion 36 has a leading surface 40 that is curved and a hole 42. The first projecting portion 36 only extends across about one-half the thickness of the handle 14 and, thus, a first recessed area 44 is established. The recessed area 44 has a surface 46 generally parallel to the center axis of the hole 42. The second and third projecting portions 37 and 38 have a slot 48 therebetween. The slot 48 is provided to receive the connection end 22 of one of the jaws 16, 17. The projection 37 only extends about three-fourths the thickness of projection 38. Thus, a second recessed area 39 is established that extends the width of surface 52. Projection 36 has a perpendicular surface 49 that is recessed relative to side 56 such that this surface 49 and surface 36 of the two handles can sit flush, or in the same plane with each other, on both sides of the handles when the handles are assembled. Holes 50, 51 are provided in each handle such that one of the bolts 24 can be used to fixedly attach the connection end 22 of each jaw of the working head 12 to the portions 37, 38 of each handle. However, any suitable means of connecting the working head 12 to the handles 14 could be provided.

In the embodiment shown, the first side 56 of each handle 14 has indicia or markings 54 about the edge of the surface 47. In the embodiment shown, indicia 54 merely comprises a molded polygonal shape of a given width on first side 56. However, any suitable type of indicia or markings could be used. A second indicia or marking 58 is provided on link 23 which sits on surfaces 39 and 49 of the assembled tool. In an alternate embodiment, however, only one side of each handle need have indicia. In addition, any suitable type of handle connection section could be provided.

As noted above, the pair of handles 14 are identical and one of the handles is merely reversed relative to the other in order to mate. As can be described best with reference to FIG. 3, the first projecting portions 36 of each handle are merely placed adjacent each other in the other handle's recessed area 44, their holes 42 aligned, links 23 are laid onto surfaces 39 and 49 with all the appropriate holes aligned, and bolt 26 (see FIG. 1) is inserted into the holes 42 to pivotally attach the two handles 14 to each other. The connection ends 22 of the jaws are then located in areas 48 of the two handles and the two bolts 24 are then inserted into the appropriate holes of the handles, jaws and links to complete assembly of the tool 10.

One of the major problems with the prior art is that the tools, due to the high forces that they are subjected to, must be periodically checked for misalignment of the handles relative to each other and, adjusted if necessary. The present invention is adapted to do away with the task of having to periodically adjust the alignment of the handles. This is accomplished by merely making the handles 14 of a relatively inexpensive material with a relatively inexpensive manufacturing cost and, providing suitable means to indicate or signal when excessive misalignment occurs. When excessive misalignment occurs, the handles are merely replaced. In the embodiment shown, the handles 14 are comprised of identical one-piece polymer members that can be molded in a relatively inexpensive manufacturing process. The bolts 24 and 26 bear against the two handles 14 inside the surfaces of the holes 42, 50 and 51. Because the handles 14 are made of a polymer material, over time and use the surfaces inside the holes 42, 50 and 51 are adapted to wear away due to the frictional forces and high compressive loads between the parts during crimping. Because the surfaces 42, 50 and 51 have been provided to wear away during prolonged use of the tool 10, indicia 54 and 58 have been provided such that, when the amount of wear of surfaces 42, 50 and 51 reaches or exceeds a predetermined amount of wear, the indicia 54 and 58 become misaligned. Thus, when the indicia 54 and 58 become misaligned, the user knows that the handle or handles 14 need to be replaced in order to allow the tool 10 to continue to obtain a good grip of a connector on a conductor, or other compression operation; i.e.: to operate within acceptable performance characteristics. Thus, the handles 14 of the present invention never need to be adjusted. Upon misalignment of indicia 54 and 58, the handle or handles are merely replaced. This eliminates the need for alignment gauges and equipment. The single handle design (both handles have the same design) of the handles 14, makes inventory and replacement much simpler than the two handle design (each handle having a different design) in the prior art. In addition, the one-piece design of handles 14 can be much less expensive than prior art handles comprised of an assembly of a multitude of different parts. As noted above, because handle 14 is made of a non-conductive polymer material, a user is afforded some additional measure of safety, over devices in the prior art, from inadvertent electrical shock through the handles 14. The prior art used a multi-piece handle assembly with a non-conductive handle section and a metal connection section to the working head. The use of a molded polymer material allows special shapes and features to be integrally formed with the handle 14 without any significant increase in cost, such as the bobbed grip end 60, knurled finish 64 in the hand grip section 28, and also such as the dielectric lengthening ribs 62 at the shaft section.

From the above description of the embodiment shown in the drawings, variations of embodiments of the invention should be obvious. For example, the handles 14 need not be identical. Each handle could be comprised of an assembly of parts or multiple types of materials. The wear surfaces could be made as replaceable inserts or the handle connection sections could be provided as replaceable inserts. The handle could also be made with hollow sections or longitudinal grooves to reduce weight, but nonetheless retain a strong structural integrity. Rather than the use of indicia on the handles or visual indication of wear, the handles could be provided with audio or other sensory perceived signals, such as the feel of the tool during crimping.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A hand operated compression tool comprising:

a working head; and a pair of handles operably connected to each other and to the working head, the handles each comprising a one-piece polymer member substantially identical to each other and merely reversed relative to each other in order to mate, the handles further comprising means for indicating wear of the handles at their connection to each other including a link connected to each handle having a marking and at least one of the handles having a marking, the markings being adapted to indicate excessive wear of the handles.

2. A tool as in claim 1 wherein the handles each have a connection end with a first side having a projecting section and an adjacent recessed section.

3. A tool as in claim 2 wherein the projecting section has a hole therethrough.

4. A tool as in claim 2 wherein the projecting sections of each handle are located adjacent each other with their holes aligned and a pin located therein.

5. A tool as in claim 1 wherein the tool has two links, each link located on an opposite side of the handles.

6. A compression tool handle for use with a second handle and a working head of a compression tool, the handle comprising:

a hand grip section at a first end;

a shaft section extending from the hand grip section; and a connection section at a second end of the shaft section, the connection section having at least one wear surface adapted to wear away during use of the handle, a second recess for receiving a portion of a first link, a third recess for receiving a portion of a second link, and a hole, the sides of the hole acting as the wear surface, the handle being comprised of a single polymer member and having a hamaphrodidic design such that two of the handles can be connected to each other in reverse fashion, and further comprising a marking on the side of the connection section adapted to indicate excessive wear of the wear surface.

7. A method of manufacturing a hand operated tool, the method comprising steps of:

providing two handles, each handle having means for connecting a portion of a working head thereto, each handle being comprised of a hamaphrodidic one-piece polymer member;

connecting the two handles to each other to provide for pivotal motion therebetween, the connection comprising a member being positioned in a hole of each hand, a side of the hole forming a wear surface, and a portion of each handle having a surface perpendicular to its hole that is adapted to slide substantially freely upon a cooperating surface of the other handle; and connecting two strengthening links to the handles, one of the links on each side of the handles, the links and handles comprising indicia to indicate excessive wear of the wear surfaces.

8. A method as in claim 7 wherein the step of connecting comprises removably connecting the handles to each other.

9. A method as in claim 7 where in the step of connecting comprises permanently connecting the handles to each other.

* * * * *

UNITED STATES PATENT AND TRADEMARK OFFICE

CERTIFICATE OF CORRECTION

PATENT NO. : 5,279,140

DATED : January 18, 1994

INVENTOR(S) : Blake et al

It is certified that error appears in the above-indentified patent and that said Letters Patent is hereby corrected as shown below:

Column 5, line 6, after "handle", insert --a first recess for reveiving a portion of the second handle,--.

Column 6, line 6, "hand" is --handle--.

Signed and Sealed this

Thirty-first Day of May, 1994

Bruce Lehman

*Attest:*

BRUCE LEHMAN

*Attesting Officer*

*Commissioner of Patents and Trademarks*